US007654760B2

(12) United States Patent
Sakano et al.

(10) Patent No.: US 7,654,760 B2
(45) Date of Patent: Feb. 2, 2010

(54) TAPE PRINTER WITH TAPE JAM ELIMINATING CONTROL IN RELATION TO TAPE CUTTING OPERATION

(75) Inventors: Yuji Sakano, Toyota (JP); Toshihiro Takahashi, Nagoya (JP); Tsuyoshi Minoya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 343 days.

(21) Appl. No.: 11/316,910

(22) Filed: Dec. 27, 2005

(65) Prior Publication Data

US 2006/0216099 A1 Sep. 28, 2006

(30) Foreign Application Priority Data

Dec. 27, 2004 (JP) ..... 2004-375382

(51) Int. Cl.
*B41J 11/66* (2006.01)
*B41J 2/32* (2006.01)
*B65H 35/06* (2006.01)

(52) U.S. Cl. ..... 400/621; 400/582; 400/615.2

(58) Field of Classification Search ..... 400/621, 400/582, 615.2, 88

See application file for complete search history.

(56) References Cited

U.S. PATENT DOCUMENTS 5,222,818 A 6/1993 Akiyama et al.
5,232,297 A 8/1993 Kitazawa
5,447,383 A 9/1995 Hirono et al.
5,829,897 A * 11/1998 Murai ..... 400/615.2
6,126,344 A 10/2000 Takayama et al.
6,142,688 A * 11/2000 Saito ..... 400/621
2006/0039738 A1 * 2/2006 Murata et al. ..... 400/615.2

FOREIGN PATENT DOCUMENTS

| | | |
|---|---|---|
| EP | 0473147 | 3/1992 |
| EP | 0534799 | 3/1993 |
| EP | 0652110 | 5/1995 |
| JP | A 07-132656 | 5/1995 |

* cited by examiner

*Primary Examiner*—Judy Nguyen
*Assistant Examiner*—Marissa L Ferguson-Samreth
(74) *Attorney, Agent, or Firm*—Oliff & Berridge, PLC

(57) ABSTRACT

A tape printer includes a cutter lever that is capable of moving within a prescribed operating range, a tape-cutting mechanism for cutting a printing tape after the printing tape has been printed by a thermal head when the cutter lever moves past a prescribed range, a cutter lever sensor for detecting movement of the cutter lever within the prescribed operating range, and drive circuits for halting the tape-feeding operation and printing operation controlled by a controller when the cutter lever sensor detects an operation by the cutter lever. With this construction, a printing mechanism, which includes a tape-feeding mechanism, is completely halted when a cutter unit is operated, thereby eliminating all tape jams.

12 Claims, 13 Drawing Sheets

TAPE PRINTER WITH TAPE JAM ELIMINATING CONTROL IN RELATION TO TAPE CUTTING OPERATION

CROSS REFERENCE TO RELATED APPLICATIONS

This application claims priority to Japanese Patent Application No. 2004-375382, filed on Dec. 27, 2004, the contents of which are hereby incorporated by reference into the present application.

TECHNICAL FIELD

The invention relates to a tape printer and particular to a tape printer having a controller for receiving output from an operation sensor during a printing operation and for halting a tape feeding operation and the printing operation upon determining that the operation of a cutting operation member is an operation for contacting a manual cutter.

BACKGROUND

Conventional tape printers generally include a keyboard, a display, and a printing mechanism. The tape printer may have a tape cassette for accommodating a tape-like printing medium having a width of 12 mm, 18 mm, or the like. Using this printing mechanism, the tape printer can make labels by printing letters, symbols, or other characters inputted via the keyboard onto the tape. Tape printers with additional editing functions have also been proposed.

One proposal for a tape printer introduced the idea of mounting a simple manual cutter in the tape printer near the exiting point of the printing tape for facilitating the cutting of printing tape at a desired position after the tape has been printed with characters. This tape printer has a simple construction that includes scissors having a movable blade and a fixed blade capable of easily and cleanly cutting the printing tape when the user pushes a cutting button.

However, tape printers having such a simple manual cutter allow the user to cut the printing tape at an arbitrary timing, regardless of whether a printing operation is being performed to drive a tape-feeding mechanism for feeding the tape and to control the thermal head for printing the tape. Hence, if a cutting operation is mistakenly executed while a printing operation is being performed, for example, the scissors of the manual cutter pinch the printing tape while the tape is still being formed and fed. Under these circumstances, the printing tape cannot be fed out of the tape printer and becomes tangled with and jammed in the driving system near the exit of the tape cassette, causing the tape cassette to malfunction.

Therefore, as disclosed in Japanese unexamined patent application publication No. HEI-7-132656, the inventors of the invention proposed a tape printer including a manual cutter for cutting a tape at a position downstream of the printing position through the operation of a cutting operation member after the tape has been printed by a printing head of printing means; cutter operation detecting means for detecting when the manual cutter begins a cutting operation; and print stopping means for receiving output from the cutter operation detecting means and stopping the printing operation by controlling means when the manual cutter begins a cutting operation.

However, since the conventional tape printer described above halts the printing means, which includes a tape-feeding mechanism, when the manual cutter begins a cutting operation, the scissors of the manual cutter are stopped after moving slightly due to the position and clearance of the detecting means. Therefore, when a wide tape is being used, the printing means including the tape-feeding mechanism is sometimes stopped after cutting has begun, causing the tape to jam. In other cases, the cutting operation is started when the user accidentally touches the manual cutter.

SUMMARY

In view of the foregoing, it is an object of the invention to provide a tape printer capable of stopping printing means including a tape-feeding mechanism before a manual cutter begins operating, in order to prevent the tape from jamming, and capable of preventing the manual cutter from operating when the user mistakenly touches the cutting operation member.

These objects and others will be attained by a tape printer that includes a print unit, a cutting operation member, a cutter unit, an operating member detecting unit, and a controller. The printing unit has a tape-feeding mechanism that performs a feeding operation of a tape accommodated in a tape cassette, and a print head that performs a printing operation on the tape to provide a printed tape. The cutting operation member moves within a prescribed range of motion. The cutter unit cuts the printed tape when the cutting operation member moves past a prescribed point within the prescribed range of motion. The operating member detecting unit detects an operation of the cutting operation member within the prescribed range of motion. The controller controls the tape-feeding mechanism and the print head to halt the tape feeding operation and the printing operation when the operating member detecting unit detects an operation of the cutting operation member.

With this construction, the printing unit having the tape-feeding mechanism is completely halted when the cutter unit is operated, thereby eliminating tape jams.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE EMBODIMENTS

Figure 1:
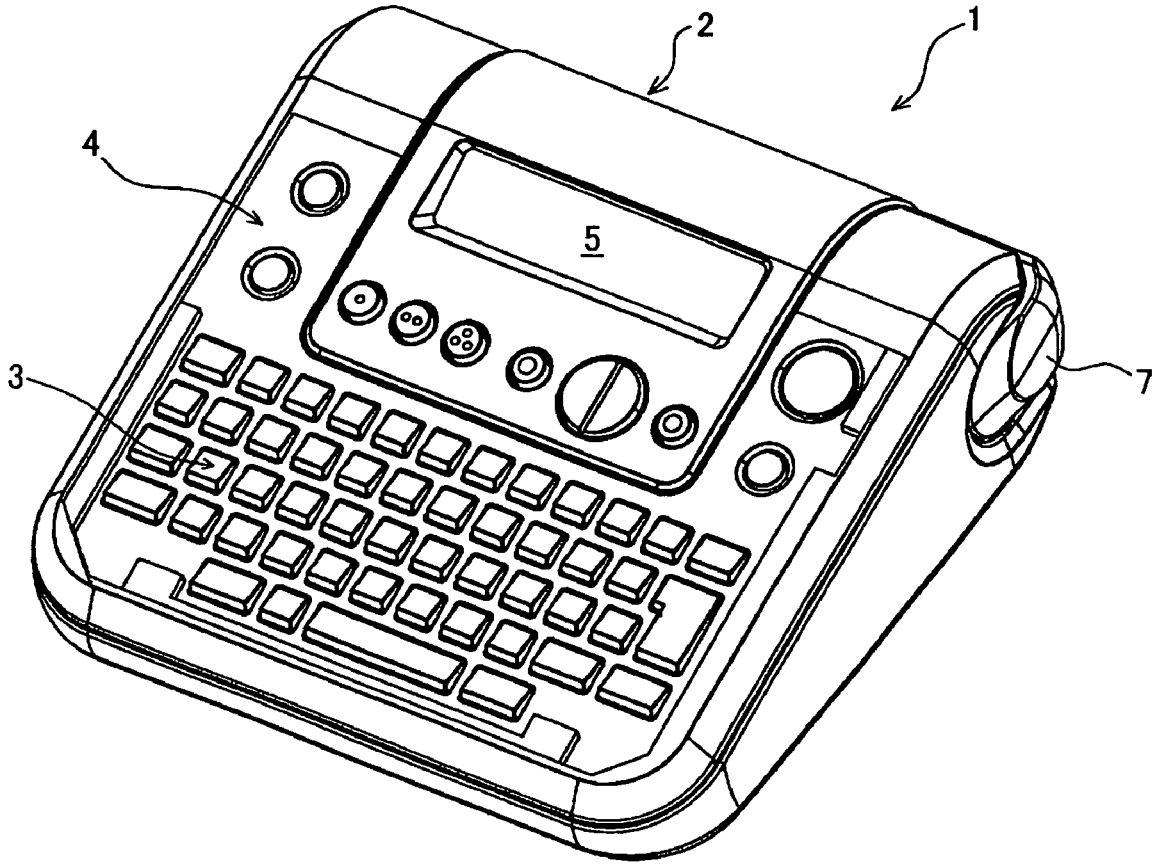
FIG. 1 is a perspective view showing the external appearance of a tape printer according to a first embodiment of the invention.
Figure 2:
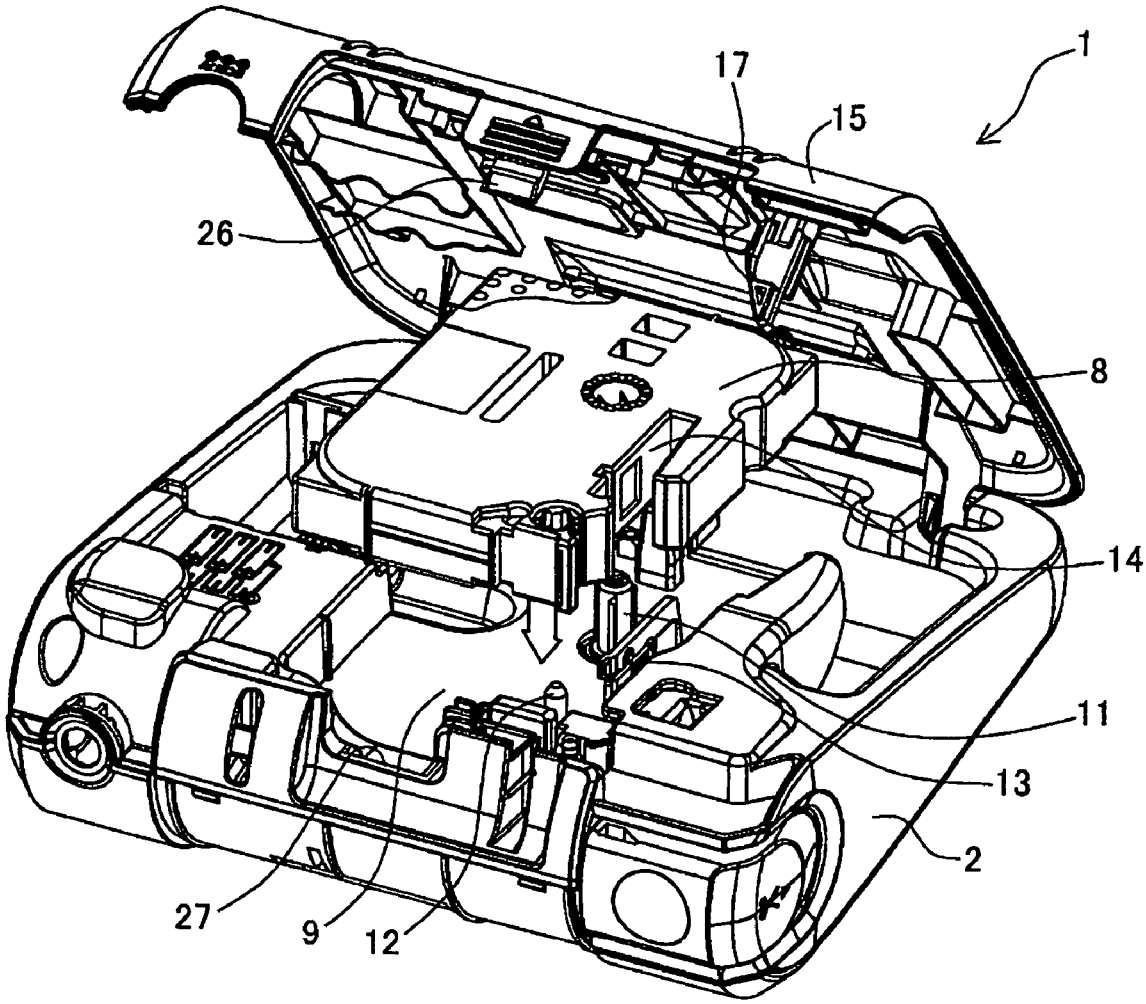
FIG. 2 is a perspective view from a rear side of the tape printer when a cassette cover is open.
Figure 3:
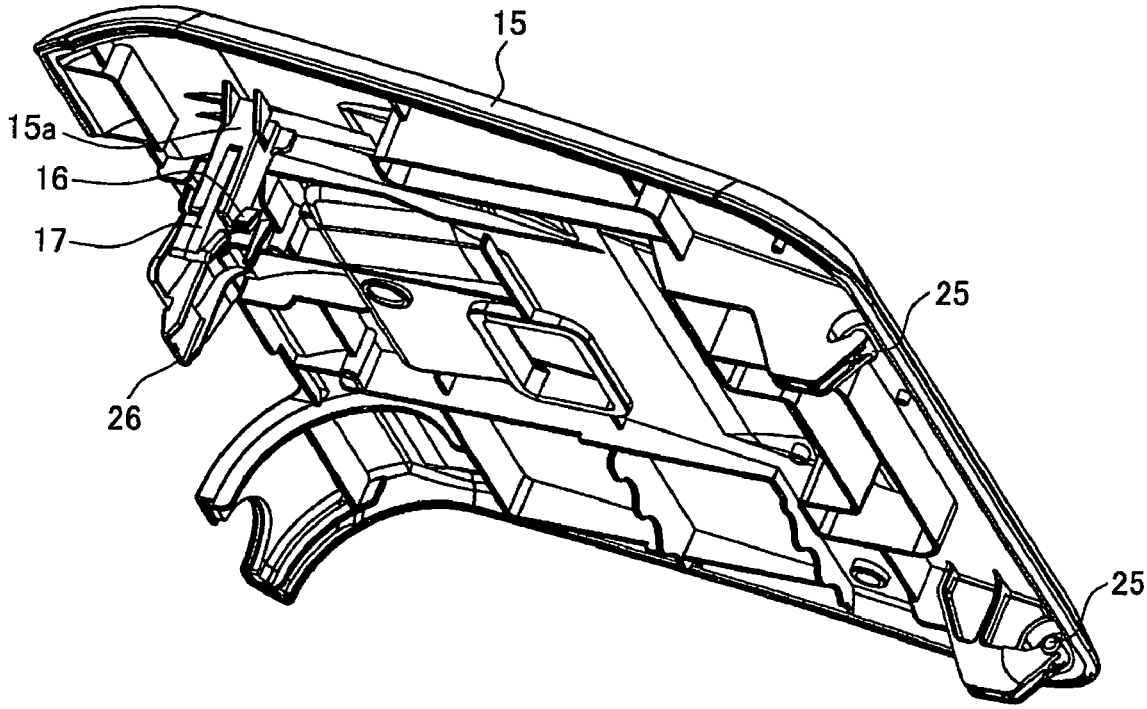
FIG. 3 is a perspective view showing the cassette cover as viewed from the inner side.
Figure 4:
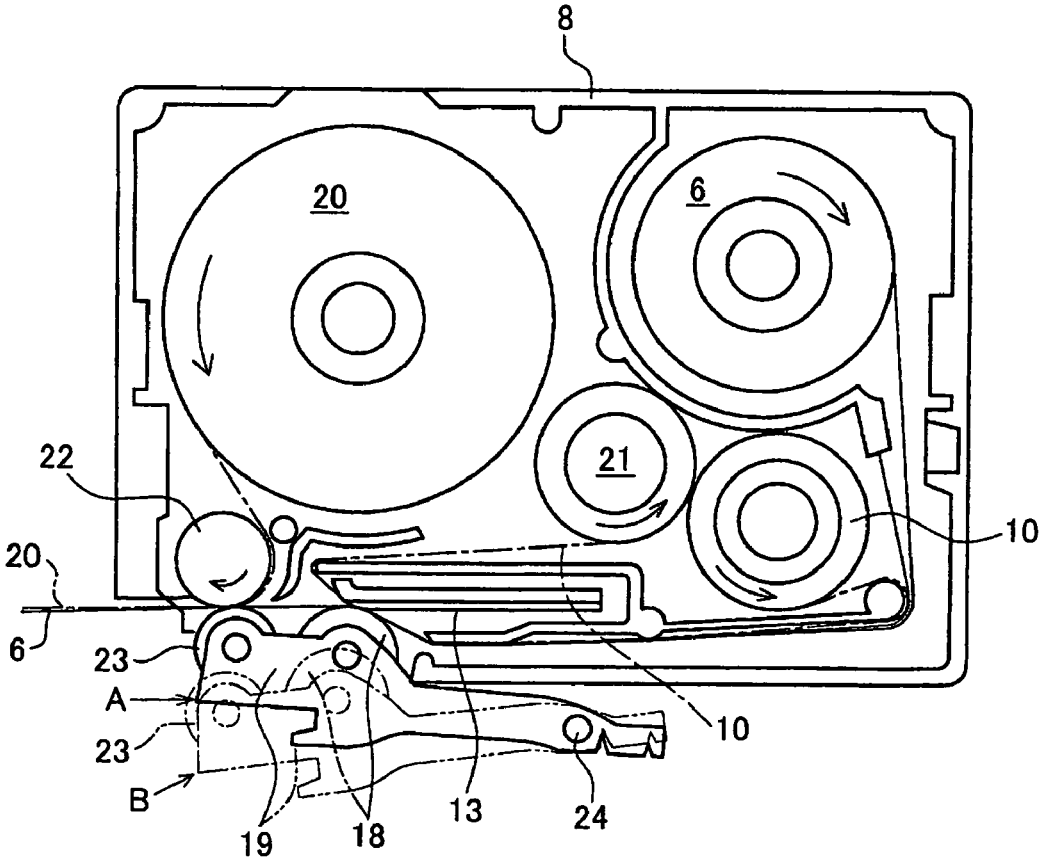
FIG. 4 is an explanatory diagram illustrating an internal structure of a tape cassette and a printing region.

Next, a tape printer according to embodiments of the invention will be described while referring to the accompanying drawings. First, the structure of a tape printer 1 according to a first embodiment of the invention will be described with reference to FIGS. 1 through 4. FIG. 1 is a perspective view showing the external appearance of a tape printer according to a first embodiment of the invention. FIG. 2 is a perspective view from a rear side of the tape printer when a cassette cover is open. FIG. 3 is a perspective view showing the cassette cover from below. FIG. 4 is an explanatory diagram illustrating an internal structure of a tape cassette and a printing region.

As shown in FIG. 1, the tape printer 1 according to the first embodiment includes a casing 2 having a sloped top surface, and a keyboard 3 disposed in the top surface of the casing 2 for inputting various characters and the like. Also in the top surface of the casing 2 above the keyboard 3, the tape printer 1 includes a power switch, a print key, a group of function keys 4 for controlling the tape printer 1 to perform various functions, and a liquid crystal display (hereinafter abbreviated as LCD) 5 for displaying inputted letters, symbols, and other characters. A cutter lever 7 is also provide in the upper right corner of the tape printer 1 for cutting a printing tape 6 (see FIG. 4) after the printing tape 6 has been printed.

As shown in FIG. 2, a cassette holder 9 is formed in the bottom surface of the casing 2 near the bottom rear thereof (the near side in FIG. 2). A tape cassette 8 accommodating the printing tape 6 in a cassette case of a prescribed shape can be mounted in the cassette holder 9. Arranged in the cassette holder 9 are a ribbon take-up cam 11 for taking up a used ink ribbon 10 (described later) in the tape cassette 8, and a tape-feeding roller cam 12 for feeding the printed printing tape 6. The cassette holder 9 also includes a thermal head 13 for printing the printing tape 6. The thermal head 13 fits into an accommodating space 14 formed in the tape cassette 8 when the tape cassette 8 is mounted in the cassette holder 9.

A cassette cover 15 that can open and close is disposed on the bottom of the casing 2 for covering the cassette holder 9 or enabling access to the same. The cassette cover 15 includes an extended part 15*a* that extends down from the cassette cover 15, a receding cam part 16 formed integrally with the extended part 15*a*, and a pressing cam part 17 mounted on the extended part 15*a* (see FIG. 3). The tape printer 1 also includes a roller holder 19 (see FIG. 4). The roller holder 19 holds a platen roller 18 and a pressure roller 23. The roller holder 19 is capable of moving between a pressing position A in which the platen roller 18 is pressed against the thermal head 13 and a receded position B in which the platen roller 18 is separated from the thermal head 13.

FIG. 4 shows the internal structure of the tape cassette 8 for a cassette accommodating a laminated tape. For explanatory purposes, FIG. 4 shows the internal structure of the tape cassette 8, as well as the thermal head 13, roller holder 19, and the like provided in the cassette holder 9 as part of the printing mechanism of the tape printer 1.

As shown in FIG. 4, the tape cassette 8 accommodates the printing tape 6 formed of a transparent film having a prescribed width, the ink ribbon 10 coated on one surface with ink to be transferred onto the printing tape 6, and a double-sided tape 20 having the same width as the printing tape 6 for bonding to the back surface of the printing tape 6 after the printing tape 6 has been printed. Each of the printing tape 6, ink ribbon 10, and double-sided tape 20 are wound in a roll shape around supply spools that are rotatably disposed in the tape cassette 8. A used ribbon take-up spool 21 is disposed in the tape cassette 8 at a position surrounded by the printing tape 6, ink ribbon 10, and double-sided tape 20 for taking up the portion of the ink ribbon 10 that has been used for printing. A tape-feeding roller 22 is also accommodated in the tape cassette 8 near the accommodating space 14 for discharging the printed printing tape 6 out of the tape cassette 8 and for fixing the double-sided tape 20 to the back surface of the printed printing tape 6.

When the tape cassette 8 is mounted in the cassette holder 9 of the tape printer 1, the ribbon take-up cam 11 of the cassette holder 9 is coupled with the used ribbon take-up spool 21 of the tape cassette 8, and the tape-feeding roller cam 12 of the cassette holder 9 is coupled with the tape-feeding roller 22 of the tape cassette 8. The used ribbon take-up spool 21 and the tape-feeding roller 22 are driven to rotate during a printing operation, by which rotation the printing tape 6 and the ink ribbon 10 are pulled from their respective supply spools and conveyed in a laminated state to the thermal head 13 to undergo a prescribed printing operation. After the printing operation, the ink ribbon 10 is separated from the printed printing tape 6 and taken up on the used ribbon take-up spool 21. Subsequently, the double-sided tape 20 is supplied and bonded to the printed printing tape 6 and the laminated tape is discharged out of the tape cassette 8 by the tape-feeding roller 22. At this time, the printing tape 6 is cut according to the operation of the cutter lever 7 described later.

Next, the mechanism for pressing the printing tape 6 against the thermal head 13 during a printing operation will be described. As shown in FIG. 2, the thermal head 13 disposed in the cassette holder 9 becomes positioned in the accommodating space 14 of the tape cassette 8 when the tape cassette 8 is mounted in the cassette holder 9. At this time, the platen roller 18 is disposed in a position facing the thermal head 13 with the printing tape 6 interposed therebetween. The pressure roller 23 is disposed in a position opposing the tape-feeding roller 22 of the tape cassette 8. Both the platen roller 18 and the pressure roller 23 are rotatably mounted in the roller holder 19, and the roller holder 19 is pivotably mounted on a holder shaft 24. Accordingly, the roller holder 19 can pivot between the pressing position A (solid line) for pressing the platen roller 18 and pressure roller 23 against the thermal head 13 and tape-feeding roller 22 respectively, and the receded position B (dotted line) in which the platen roller 18 and pressure roller 23 are separated from the thermal head 13 and the tape-feeding roller 22.

Figure 5A:
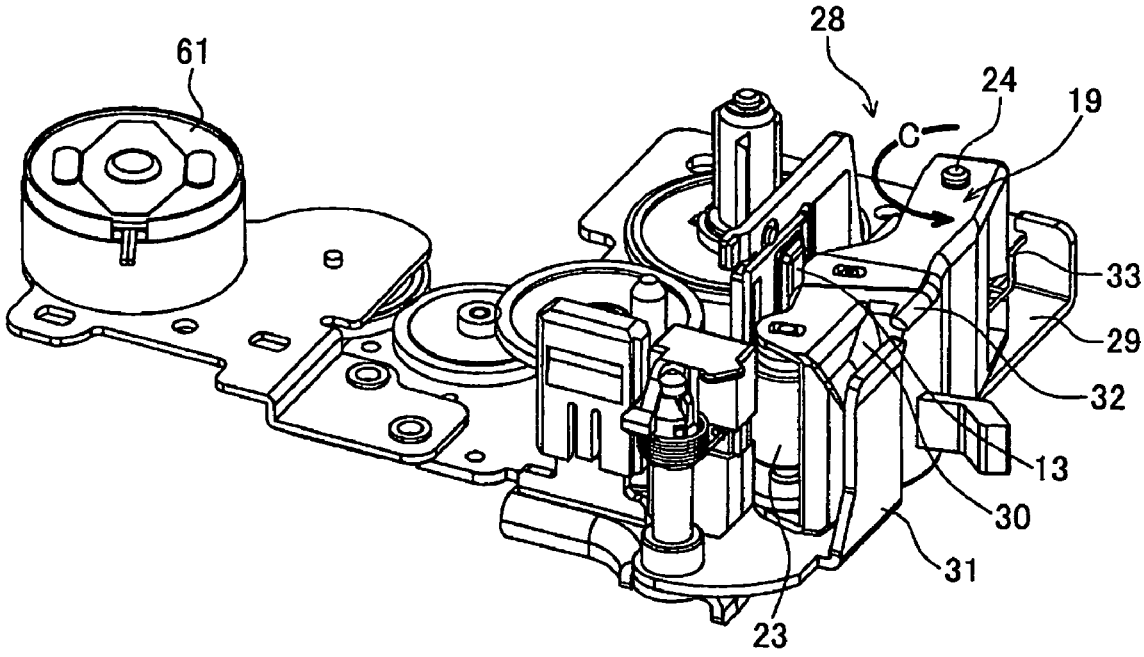
FIG. 5A is a perspective view of the overall printing mechanism.
Figure 5B:
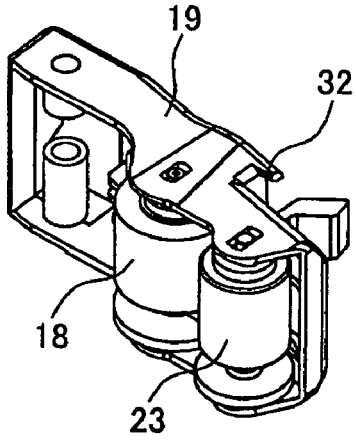
FIG. 5B is a perspective view showing a roller holder of the printing mechanism as viewed from the opposite side with respect to that shown in FIG. 5A.
Figure 6A:
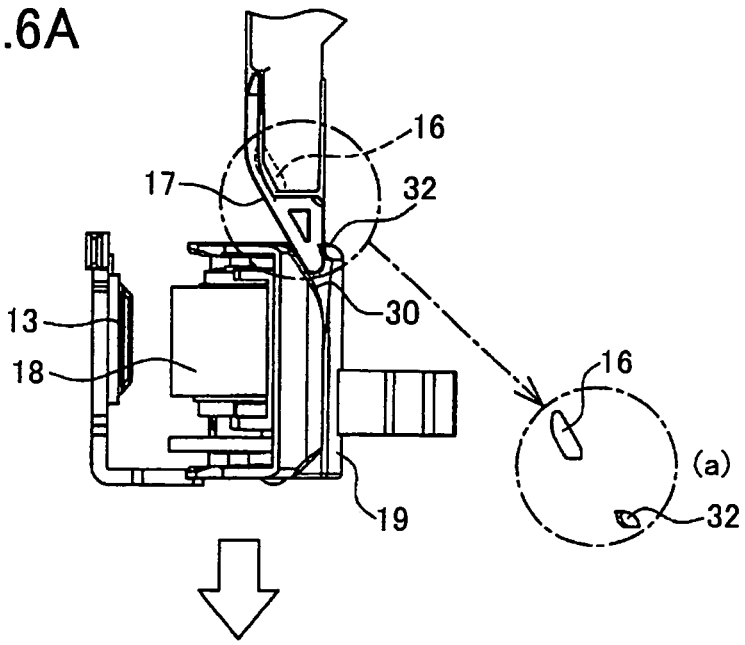
FIG. 6A is an explanatory diagram showing a, condition when the pressing cam part first contacts a pressing cam receiving part.
Figure 6B:
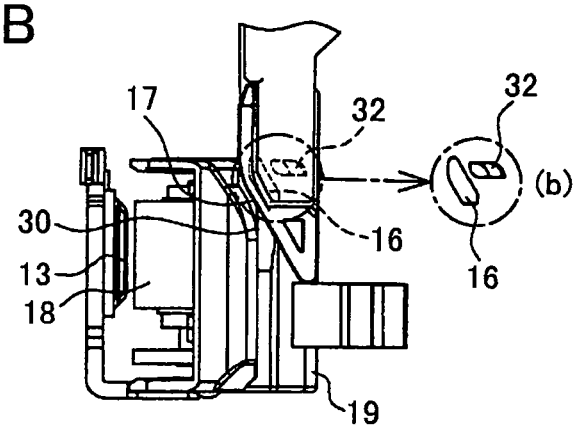
FIG. 6B is an explanatory diagram showing a condition when the pressing cam part further contacts the pressing cam receiving part and just prior to rollers in the roller holder contacting a platen roller and thermal head.
Figure 6C:
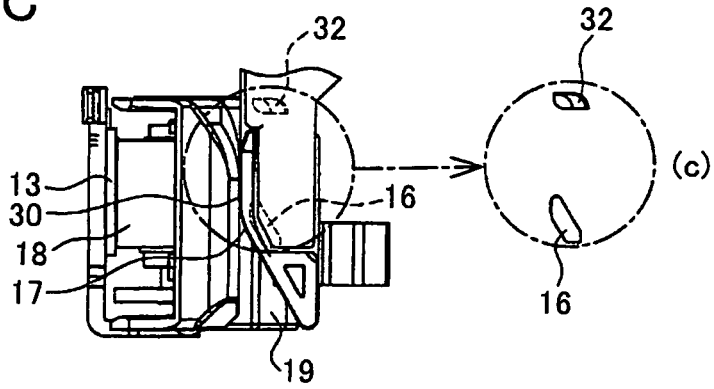
FIG. 6C is an explanatory diagram showing a condition when the pressing cam part is in full contact with the pressing cam receiving part and the rollers in the roller holder contact the platen roller and the thermal head.
Figure 7A:
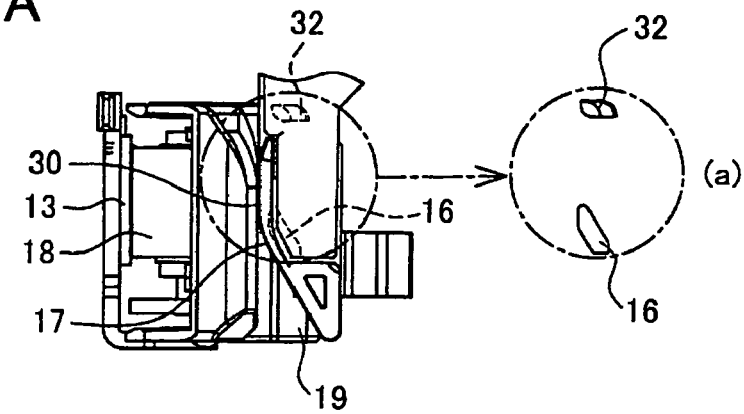
FIG. 7A is an explanatory diagram showing a condition when the pressing cam part is in full contact with the pressing cam receiving part and the rollers in the roller holder contact the platen roller and thermal head.
Figure 7B:
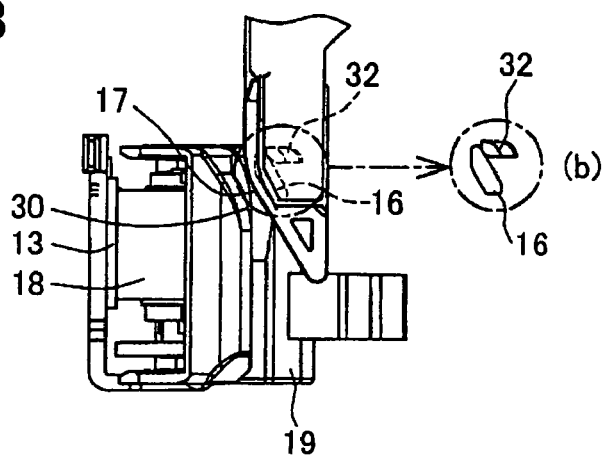
FIG. 7B is an explanatory diagram showing a condition when the pressing cam part is pulled upward, a receding cam part begins to contact a receding cam receiving part, and the point just before contact with the platen roller and thermal head is broken.
Figure 7C:
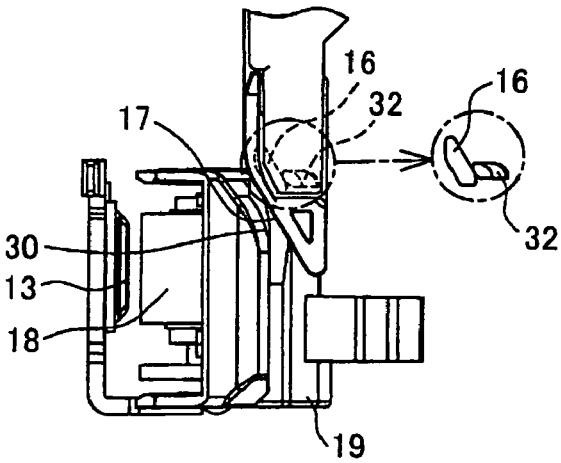
FIG. 7C is an explanatory diagram showing a condition when the receding cam part further contacts the receding cam receiving part, and the point after the contact with the platen roller and thermal head has been broken.

Next, the mechanism for pressing the platen roller 18 and pressure roller 23 against the thermal head 13 and tape-feeding roller 22 and for releasing this pressure by opening and closing the cassette cover 15 covering the cassette holder 9 will be described with reference to FIGS. 2, 3, 5, and 7. FIG. 5A is a perspective view of the overall printing mechanism. FIG. 5B is a perspective view showing a roller holder of the printing mechanism from the opposite side shown in FIG. 5A. FIGS. 6A through 6C are a series of explanatory diagrams illustrating the relationship between pressing/receding cam parts and the roller holder when closing the cassette cover. FIG. 6A shows when the pressing cam part first contacts a pressing cam receiving part. FIG. 6B shows the point when the pressing cam part further contacts the pressing cam receiving part and just prior to rollers in the roller holder contacting a platen roller and thermal head. FIG. 6C shows the pressing cam part in full contact with the pressing cam receiving part and the rollers in the roller holder contacting the platen roller and the thermal head. FIGS. 7A through 7C are a series of explanatory diagrams illustrating the relationship between the pressing cam part and the roller holder when the cassette cover is opened and while the thermal head and platen roller are attached. FIG. 7A shows the pressing cam part in full contact with the pressing cam receiving part and the rollers in the roller holder contacting the platen roller and thermal head. FIG. 7B shows the pressing cam part being pulled upward, a receding cam part beginning to contact a receding cam receiving part, and the point just before contact with the platen roller and thermal head is broken. FIG. 7C shows the receding cam part further contacting the receding cam receiving part, and the point after the contact with the platen roller and thermal head has been broken;

The cassette cover 15 shown in FIGS. 2 and 3 is capable of opening and closing over the cassette holder 9 for exposing and covering the same. The cassette cover 15 is mounted on the body of the tape printer 1 by hinges 25, shown in FIG. 3. Hence, the cassette cover 15 can expose or cover the cassette holder 9 by rotating about the hinges 25. An engaging piece 26 is provided on the end of the cassette cover 15. An engaging part 27 is provided on the main casing side of the tape printer 1 for engaging the engaging piece 26 to maintain the cassette cover 15 in a closed position. The engaging piece 26 has elasticity, enabling the user to release the engagement and open the cassette cover 15 through a prescribed operation.

As shown in FIG. 5A, a printing mechanism 28 is disposed in the cassette holder 9. The printing mechanism 28 includes a frame 29 that is fixed with respect to the tape printer 1. The roller holder 19 holding the platen roller 18 and pressure roller 23 is rotatably mounted on the frame 29. Specifically, the holder shaft 24 is fixed to the frame 29, and the roller holder 19 is rotatably supported about the holder shaft 24, as described above. By rotating in the direction of the arrow C in FIG. 5A, the roller holder 19 moves to a receded position B (see FIG. 4) in which the platen roller 18 and pressure roller 23 are separated from the thermal head 13 and tape-feeding roller 22. By rotating in the direction opposite the arrow C, the roller holder 19 moves to a pressing position A (see FIG. 4) in which the platen roller 18 and pressure roller 23 are pressed against the thermal head 13 and tape-feeding roller 22 with the printing tape 6 of the tape cassette 8 interposed therebetween.

A pressing cam receiving part 30 is formed in the roller holder 19 for slidably contacting the pressing cam part 17 provided on the extended part 15*a* of the cassette cover 15 when the cassette cover 15 is closed. An auxiliary pressing frame 31 is erected on the frame 29 for preventing the pressing cam part 17 from slipping out of the pressing cam receiving part 30 when the pressing cam part 17 is pressed against the pressing cam receiving part 30.

A receding cam receiving part 32 is also formed in the roller holder 19 for slidably contacting the receding cam part 16 formed integrally with the extended part 15*a* when the cassette cover 15 is closed. A toggle spring 33 is mounted on the holder shaft 24 inside the frame 29 for urging the roller holder 19 in the direction toward the receded position B.

Next, the functions of the pressing cam part 17 and pressing cam receiving part 30 and the receding cam part 16 and receding cam receiving part 32 when the cassette cover 15 is opened and closed will be described with reference to FIGS. 6 and 7.

The aforementioned operations will be described first with reference to FIGS. 6A through 6C when the cassette cover 15 is closed. As shown in FIG. 6A, as the cassette cover 15 is closed, the pressing cam part 17 disposed on the extended part 15*a* contacts the pressing cam receiving part 30 of the roller holder 19. Up to this time, the roller holder 19 has been maintained in the receded position B by the urging force of the toggle spring 33. Now, however, the pressing cam part 17 begins moving the roller holder 19 toward the thermal head 13 side (left in FIG. 6A) against this urging force. In FIG. 6A, the receding cam part 16 and receding cam receiving part 32 are not in contact with each other.

As the cassette cover 15 is closed further to the state shown in FIG. 6B, the pressing cam part 17 is in fuller contact with the pressing cam receiving part 30, moving the roller holder 19 farther toward the thermal head 13 until the thermal head 13 and platen roller 18 are nearly in contact with each other. In the state shown in FIG. 6B, the receding cam part 16 and receding cam receiving part 32 are not in contact with each other but are positioned adjacent to one another in the left-to-right direction.

When the cassette cover 15 has been completely closed in the state shown in FIG. 6C, a vertical part of the pressing cam part 17 is in contact with a vertical part of the pressing cam receiving part 30, and the roller holder 19 is in the pressing position A in which the thermal head 13 and platen roller 18 are in full contact with each other. While the tape cassette 8 is not mounted in this example, had the tape cassette 8 been mounted, the printing tape 6 and the ink ribbon 10 would be interposed between the thermal head 13 and platen roller 18 at this time. As the pressing cam part 17 has pressed the platen roller 18 into the thermal head 13 against the urging force of the toggle spring 33, the auxiliary pressing frame 31 disposed on the right side of the pressing cam part 17 in FIG. 6C prevents the pressing cam part 17 from deforming. As shown in FIG. 6C, the receding cam part 16 and receding cam receiving part 32 are positioned in a vertical relationship, but are still not in contact with each other. If the tape cassette 8 were mounted in the tape printer 1 at this time, the tape printer 1 would be capable of performing a tape printing operation.

Next, the functions of the aforementioned parts will be described with reference to FIGS. 7A through 7C when the cassette cover 15 is opened. FIG. 7A shows the state identical to that in FIG. 6C from which the cassette cover 15 is opened.

When the cassette cover 15 is opened to the state shown in FIG. 7B, the vertical part of the pressing cam part 17 is lifted out of contact with the vertical part of the pressing cam receiving part 30, and the platen roller 18 begins separating from the thermal head 13 due to the constant urging force of the toggle spring 33. However, if the tape printer 1 has been stored for a long period of time without the tape cassette 8 mounted therein, the platen roller 18 may remain attached to the thermal head 13 against the urging force of the toggle spring 33. In such a case, the receding cam part 16 contacts the receding cam receiving part 32, as shown in FIG. 7B, beginning an operation to move the roller holder 19 in the direction away from the thermal head 13 (to the right in FIG. 7B).

As the cassette cover 15 is opened farther to the state shown in FIG. 7C, the receding cam receiving part 32 continues to slide in contact with the receding cam part 16, causing the roller holder 19 to move away from the thermal head 13 until the platen roller 18 has completely separated from the thermal head 13. After separation has occurred, the urging force of the toggle spring 33 will return the roller holder 19 to the receded position B.

Figure 8:
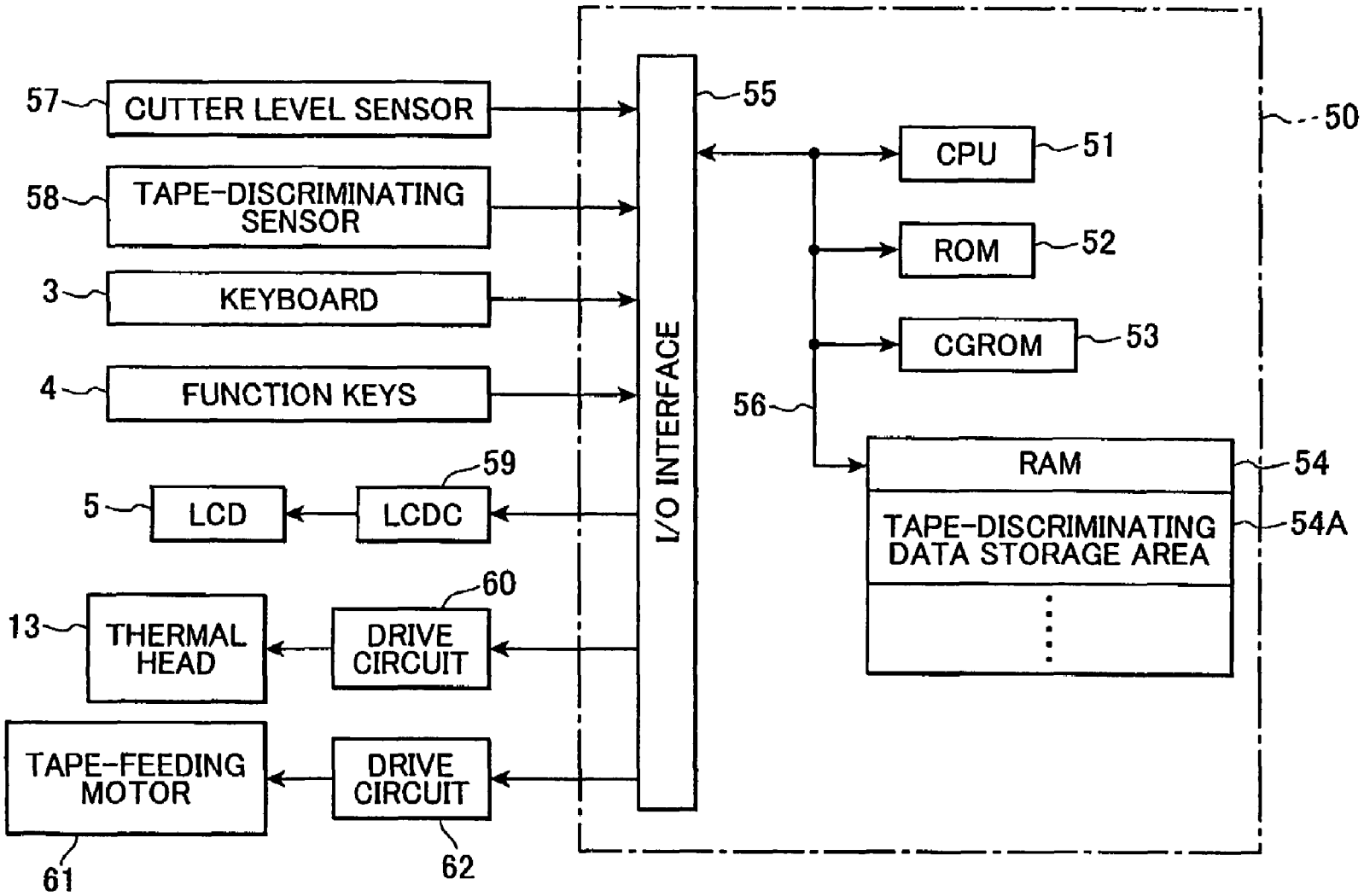
FIG. 8 is a block diagram showing a control system of the tape printer.

Next, the control system of the tape printer 1 having the construction described above will be described with reference to FIG. 8. FIG. 8 is a block diagram showing the control system of the tape printer 1. As shown in FIG. 8, the core of the tape printer 1 is a controller 50. The controller 50 includes a CPU 51, a ROM 52, a CGROM 53, a RAM 54, and an input/output interface 55, all of which components are connected together via a bus 56.

The ROM 52 stores various programs including programs required for controlling the tape printer 1, such as a print control program and a print halting program for halting a printing operation and a tape-feeding operation based on data read by a cutter lever sensor 57 described later. The CPU 51 performs various computations based on the programs stored in the ROM 52. The ROM 52 also stores outline data defining the outlines of letters and other characters in association with code data that has been sorted according to font type.

The CGROM 53 stores dot pattern data corresponding to each character inputted via the keyboard 3. The CPU 51 reads the dot pattern data from the CGROM 53 and displays dot patterns on the LCD 5 based on this data. The RAM 54 functions to temporarily store results of the computations performed by the CPU 51. The RAM 54 is provided with a tape-discriminating data storage area 54A for storing a tape-discriminating data table (not shown). When a tape-discriminating sensor 58 detects the type of the tape cassette 8 mounted in the casing 2, the CPU 51 reads data outputted from the tape-discriminating sensor 58 and references the tape-discriminating data storage area 54A to determine the type of the tape cassette 8. The RAM 54 is also provided with other memory areas including a text memory area, an image buffer, and a print buffer.

The input/output interface 55 is also connected to the cutter lever sensor 57 disposed in the casing 2, the tape-discriminating sensor 58 (see FIG. 10), the keyboard 3, and the function keys 4. A display controller (LCDC) 59 is also connected to the input/output interface 55 for driving the LCD 5. When the user inputs characters via the keyboard 3, text data for these characters is sequentially stored in the text memory of the RAM 54, and the CPU 51 displays dot patterns corresponding to the inputted characters on the LCD 5 based on a dot pattern generation control program and a display control program. A drive circuit 60 is also connected to the input/output interface 55 for driving the thermal head 13. The drive circuit 60 drives the thermal head 13 to print dot pattern data on the printing tape 6 via the ink ribbon 10 and in cooperation with the platen roller 18. The thermal head 13 prints dot pattern data that has been transferred from the image buffer to the print buffer in the RAM 54. A drive circuit 62 is also connected to the input/output interface 55 for driving a tape-feeding motor 61 (see FIG. 5A). When driven by the drive circuit 62, the tape-feeding motor 61 works in cooperation with the tape-feeding roller 22 to affix the printed printing tape 6 to the double-sided tape 20 and to discharge the printed printing tape 6 now laminated with the double-sided tape 20 from the tape printer 1.

Figure 9:
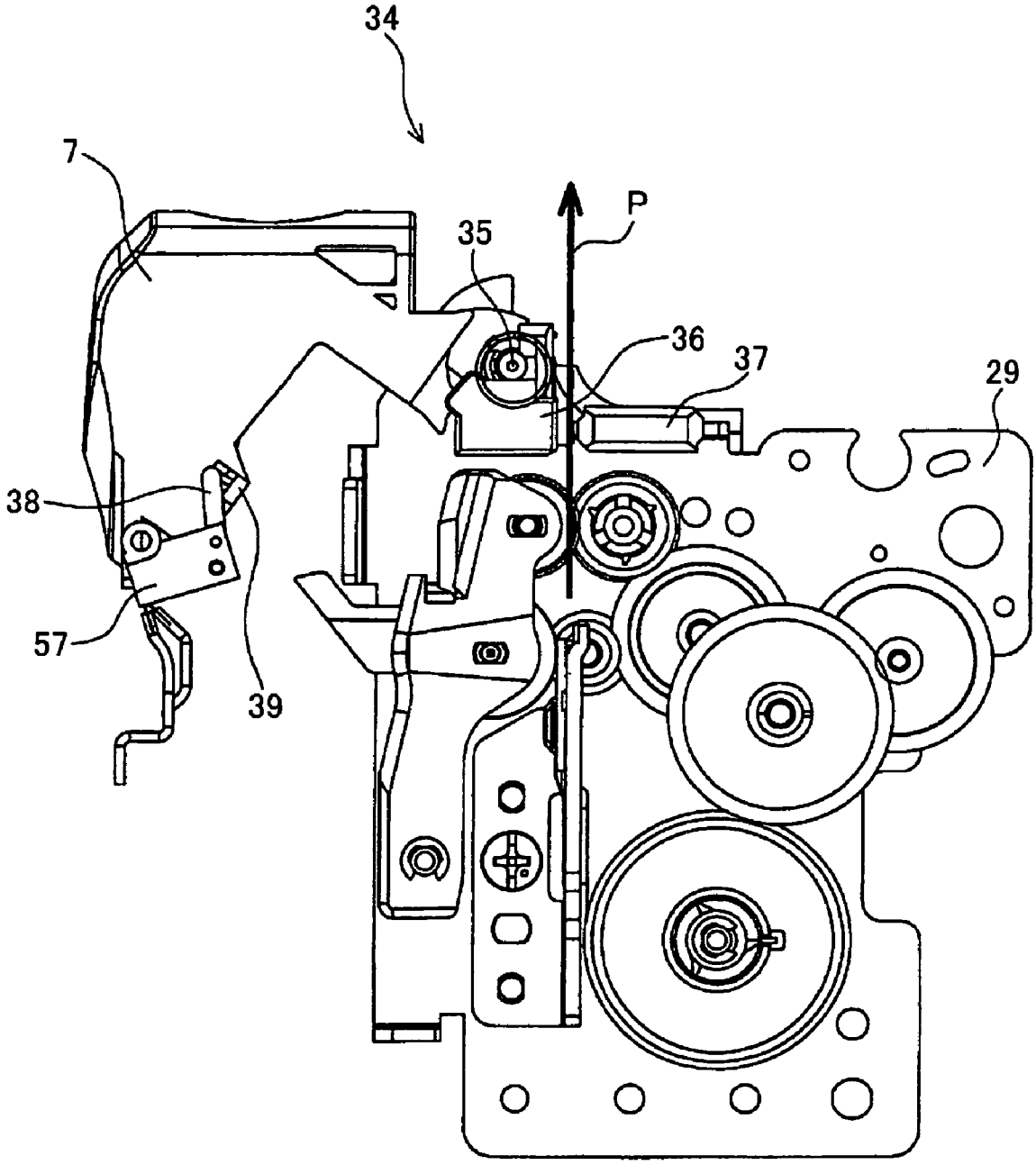
FIG. 9 is an explanatory diagram showing a push-type tape-cutting mechanism of the tape printer.

As shown in FIG. 9, the tape printer 1 is provided with a push-type tape-cutting mechanism 34 disposed downstream of the printing mechanism with respect to the direction that the printed printing tape 6 is discharged for manually cutting the printed printing tape 6. FIG. 9 is an explanatory diagram showing the structure of the push type tape-cutting mechanism in the tape printer 1.

Figure 10:
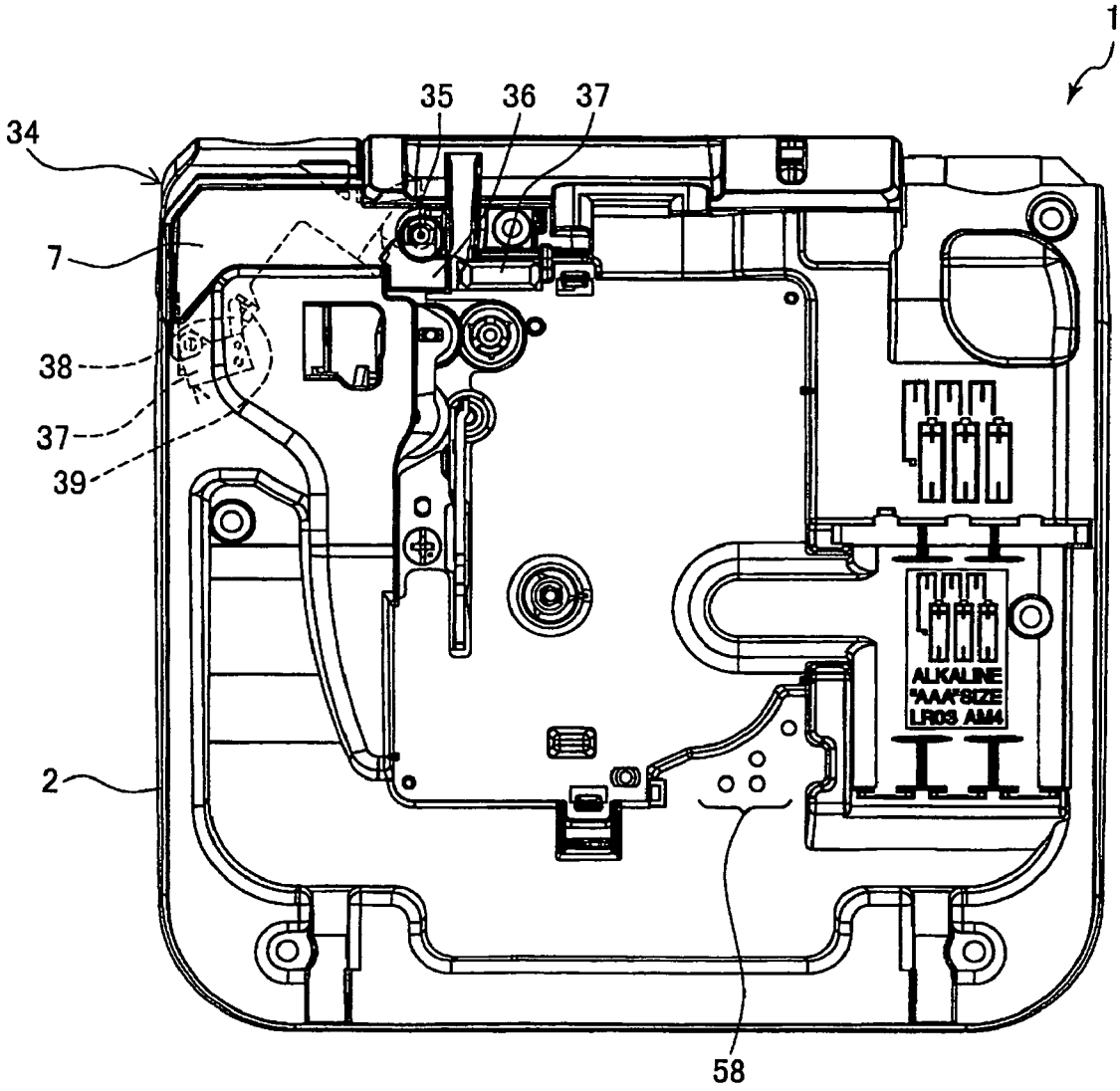
FIG. 10 is a rear view of the tape-cutting mechanism after the cassette cover has been removed from the tape printer.
Figure 11:
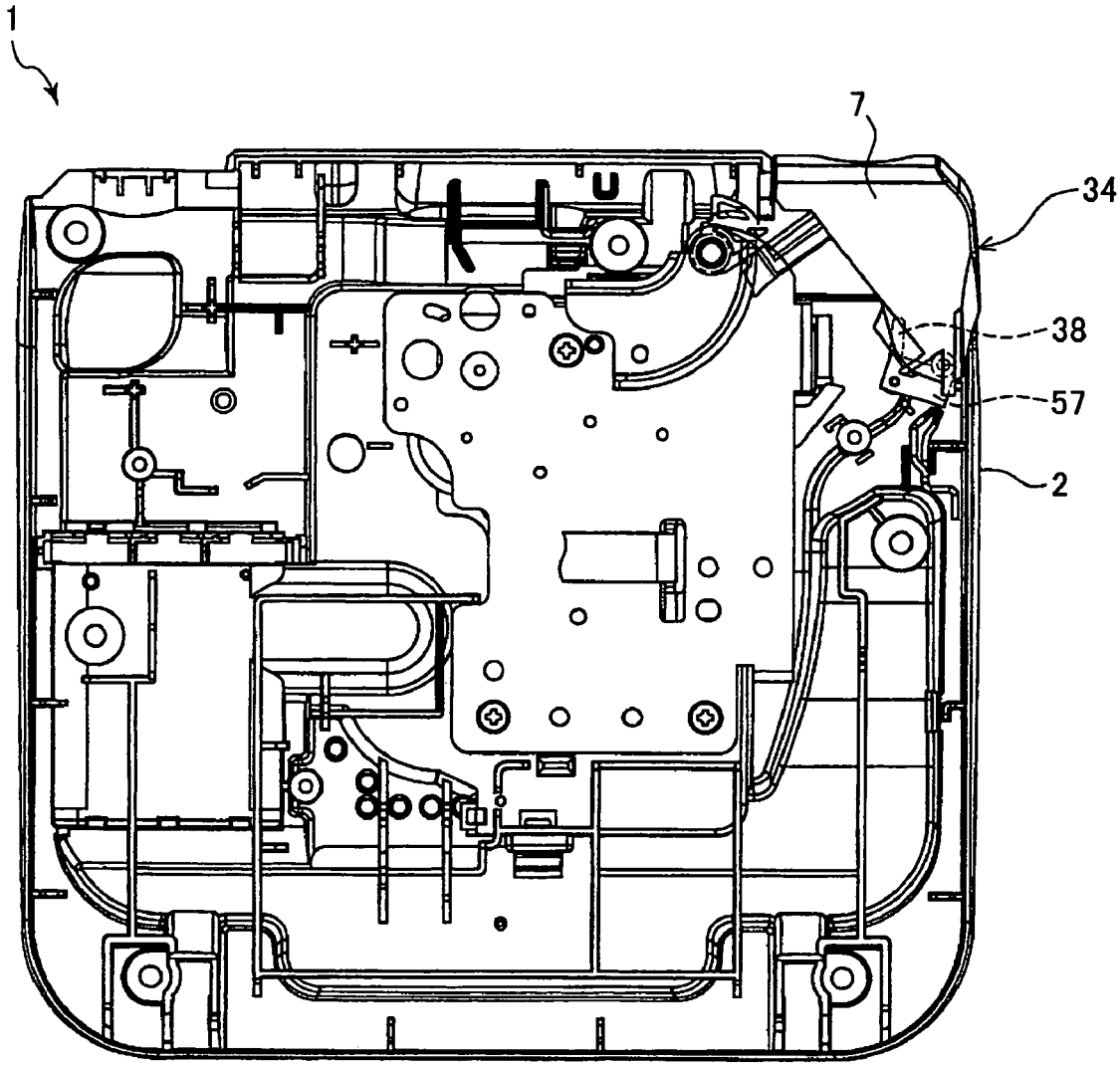
FIG. 11 is an explanatory diagram showing the structure of the tape-cutting mechanism as viewed from inside of the tape printer.

Next, the structure of the push-type tape-cutting mechanism 34 will be described with reference to FIGS. 9 through 11. FIG. 10 is a rear view of the tape-cutting mechanism after the cassette cover has been removed from the tape printer. FIG. 11 is an explanatory diagram showing the structure of the tape-cutting mechanism from inside the tape printer.

As shown in FIG. 9, the tape-cutting mechanism 34 includes a cutter shaft 35 that is fixed to the frame 29, the cutter lever 7 and a cutter unit 36 that are mounted on the cutter shaft 35 and capable of rotating about the same, and a cutter receiving member 37 mounted on the frame 29 at a position opposing the cutter unit 36. While the cutter lever 7 is not operated, the printed printing tape 6 passes between the cutter unit 36 and the cutter receiving member 37. The cutter lever sensor 57 mentioned earlier is mounted on the casing 2 near one end of the cutter lever 7 for detecting an operation of the cutter lever 7. The cutter lever sensor 57 includes a sensor lever 38. While the cutter lever 7 is not operated, the sensor lever 38 of the cutter lever sensor 57 contacts a pressure boss 39 disposed on the cutter lever 7, maintaining the cutter lever sensor 57 in an on state. FIGS. 10 and 11 also show different views of the tape-cutting mechanism 34 disposed on the casing 2.

Figure 12:
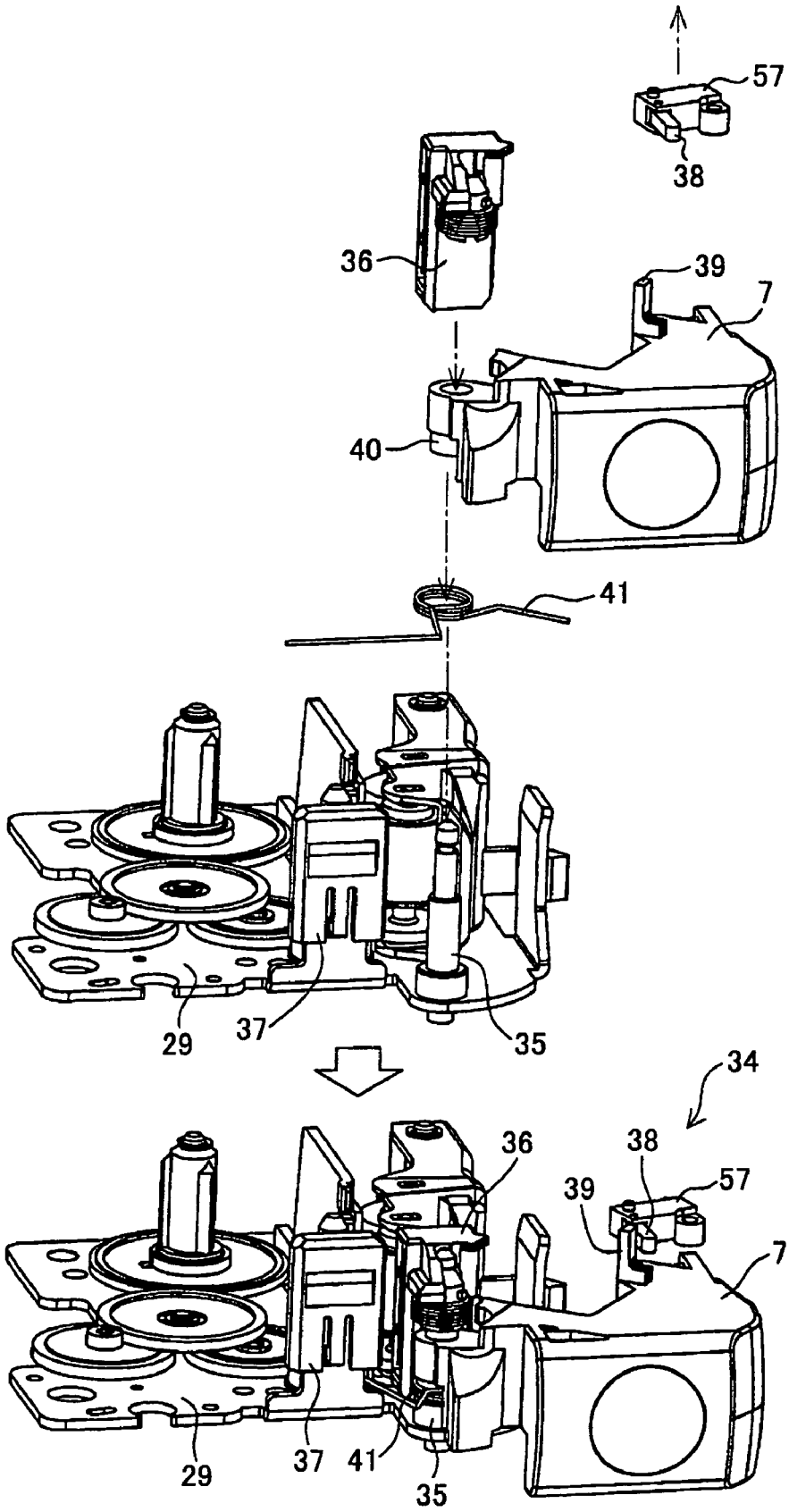
FIG. 12 is an exploded view of the tape-cutting mechanism for the tape printer.

Next, the order for assembling the tape-cutting mechanism 34 of the tape printer 1 will be described with reference to FIG. 12. FIG. 12 is an exploded diagram illustrating the assembly of the tape-cutting mechanism 34. As shown in FIG. 12, the cutter lever sensor 57 is first fastened to the casing 2 by screws (not shown). Next, the cutter receiving member 37 is fixed to the frame 29. The cutter lever 7 includes a shaft 40 and a toggle spring 41 mounted on the shaft 40. After the toggle spring 41 is mounted on the shaft 40, the cutter lever 7 is mounted on the cutter shaft 35 that is fixed to the cassette holder 9, with one end of the toggle spring 41 being fixed in a prescribed position. Hence, after the cutter lever 7 is operated and subsequently released, the cutter lever 7 returns to its original position. Next, the cutter unit 36 is mounted on the cutter shaft 35. The tape-cutting mechanism 34 having this construction is then incorporated in the casing 2 so that the sensor lever 38 of the pre-assembled cutter lever sensor 57 contacts the pressure boss 39 of the cutter lever 7.

Figure 13A:
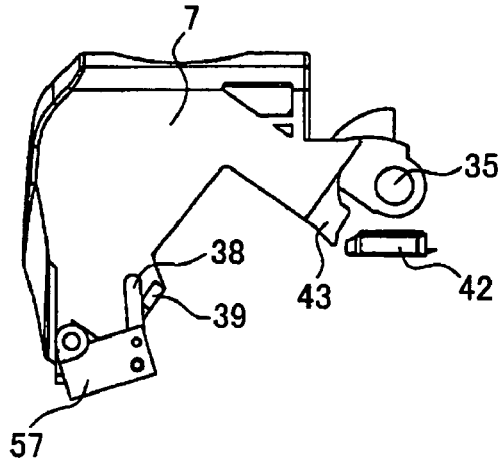
FIG. 13A is an explanatory diagram showing the tape-cutting mechanism when a cutter lever is in a standby position and a cutter lever sensor is in an ON state.
Figure 13B:
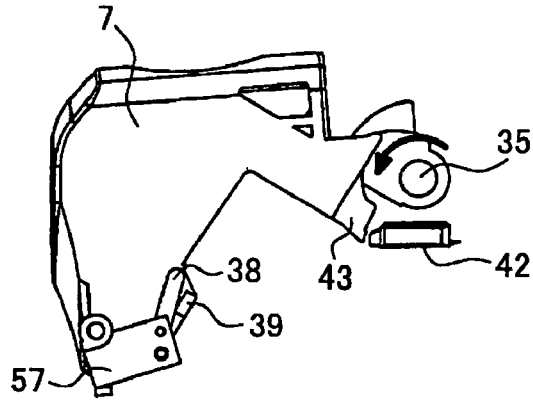
FIG. 13B is an explanatory diagram showing the tape-cutting mechanism when the cutter lever is rotated until the cutter lever sensor detects the operating position and switches to an OFF state.
Figure 13C:
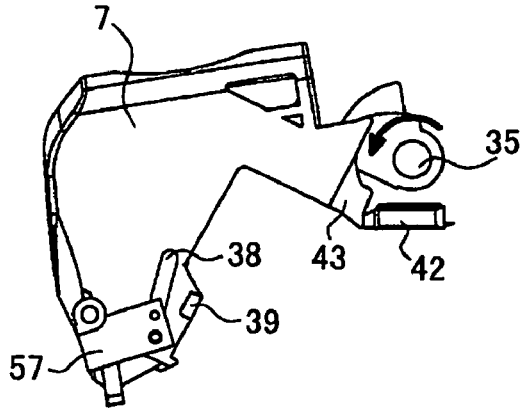
FIG. 13C is an explanatory diagram showing the tape-cutting mechanism when the cutter lever is further rotated until a cutter blade presses against a cutter blade pressing part and begins cutting.

Next, the operations of the cutter lever 7 and the cutter lever sensor 57 will be described with reference to FIGS. 13A through 13C. FIGS. 13A through 13C are a series of explanatory diagrams illustrating the operation of the tape-cutting mechanism in the tape printer, wherein FIG. 13A shows the tape-cutting mechanism when a cutter lever is in a standby position (stroke 0°) and a cutter lever sensor is in an on state, FIG. 13B shows the tape-cutting mechanism when the cutter lever is rotated until the cutter lever sensor detects the operating position (stroke 4° 18') and switches to an off state, and FIG. 13C shows the tape-cutting mechanism when the cutter lever is further rotated until a cutter blade presses against a cutter blade pressing part and begins cutting (stroke 9°).

In FIG. 13A, the cutter lever 7 is in a standby position and has not been operated. The pressure boss 39, which is an example of an engagement portion, of the cutter lever 7 passes against the sensor lever 38 of the cutter lever sensor 57 maintaining the cutter lever sensor 57 in an on state. In this state, the printing mechanism 28 can perform a tape-feeding operation and printing operation on the printing tape 6. At this time, there is a sufficiently large gap formed between a cutter blade 42 of the cutter unit 36 and a cutter blade pressing part 43 of the cutter lever 7.

In FIG. 13B, the cutter lever 7 has rotated, and the pressure boss 39 presses the sensor lever 38. When the cutter lever 7 has rotated to a prescribed position (about in the middle of its rotation) at which time the cutter lever sensor 57 turns off, the controller 50 (see FIG. 8) immediately controls the printing mechanism 28 to halt the tape-feeding operation and printing operation on the printing tape 6. At this time, the gap between the cutter blade 42 and the cutter blade pressing part 43 is about half the size of the gap in the standby position. Although the cutter lever 7 has rotated to a prescribed position (substantially in the middle of its rotation) so that the pressure boss 39 presses the sensor lever 38 and the cutter lever sensor 57 turns off, the margin is sufficient that the user cannot adversely affect the printing mechanism 28 by mistakenly touching the cutter lever 7.

In FIG. 13C, the cutter lever 7 has rotated farther so that the cutter blade 42 presses against the cutter blade pressing part 43 and begins cutting, thereby producing a printed and cut printing tape 6. Through this series of operations, the tape printer 1 of the invention can completely eliminate jamming due to the operation to cut the printing tape 6.

When employing the tape printer 1 having the printing mechanism 28 and the tape-cutting mechanism 34 described above, a tape cassette 8 must be mounted in the cassette holder 9. After mounting the tape cassette 8, the cassette cover 15 is closed, causing the engaging piece 26 to engage with the engaging part 27 of the casing 2. At this time, the printing mechanism 28 operates as described below. Specifically, as the cassette cover 15 is closed, the pressing cam part 17 disposed on the extended part 15*a* that extends from the cassette cover 15 presses against the pressing cam receiving part 30 of the roller holder 19 so that the roller holder 19 pivots in the direction opposite the arrow C into the pressing position A. Therefore, the roller holder 19 is always in the pressing position A when the cassette cover 15 is closed, and the tape printer 1 is capable of printing without any further setting operations. At this time, the user can input characters via the keyboard 3, while confirming the inputted characters on the LCD 5, and can use the function keys 4 to print the printing tape 6. Subsequently, the user can operate the cutter lever 7 to cut the printed printing tape 6 to acquire the completed tape-like label. In addition, a tape jam will not occur in the tape printer 1, even if the user mistakenly touches the cutter lever 7.

When removing the tape cassette 8 during a printing operation, no special release operation is required. The user simply presses the engaging piece 26 portion of the cassette cover 15 directly to open the cassette cover 15. By opening the cassette cover 15, the pressing cam part 17 disposed on the extended part 15*a* separates from the pressing cam receiving part 30 of the roller holder 19, thereby releasing the pressure on the roller holder 19. Accordingly, the urging force of the toggle spring 33 moves the roller holder 19 in the direction of the arrow C into the receded position B. If the tape printer 1 has been stored for a long period of time without the tape cassette 8 mounted therein, the platen roller 18 may remain attached to the thermal head 13 opposing the urging force of the toggle spring 33. However, the receding cam part 16 formed integrally with the extended part 15*a* contacts the receding cam receiving part 32 of the roller holder 19, forcing the platen roller 18, which is supported in the roller holder 19, to separate from the thermal head 13. Therefore, the tape cassette 8 can be removed and replaced immediately after opening the cassette cover 15. Hence, it is possible to mount or remove the tape cassette 8 in one operation.

As described in detail above, the tape printer 1 according to the first embodiment includes the cutter lever 7 that is capable of moving within a prescribed operating range, the tape-cutting mechanism 34 for cutting the printing tape 6 after the printing tape 6 has been printed by the thermal head 13 when the cutter lever 7 moves past a prescribed range, the cutter lever sensor 57 for detecting movement of the cutter lever 7 within the prescribed operating range, and the drive circuits 60 and 62 for halting the tape-feeding operation and printing operation controlled by the controller 50 when the cutter lever sensor 57 detects an operation by the cutter lever 7. With this construction, the printing mechanism 28, which includes a tape-feeding mechanism, is completely halted when the cutter unit 36 is operated, thereby eliminating all tape jams.

Further, in the tape printer 1 according to the first embodiment, the cutter lever sensor 57 determines that the operation of the cutter lever 7 is an operation for contacting the cutter unit 36 when the cutter lever 7 is approximately in the middle of the operating range, thereby preventing the cutter unit 36 from being operated when the user mistakenly touches the cutter lever 7.

Figure 14A:
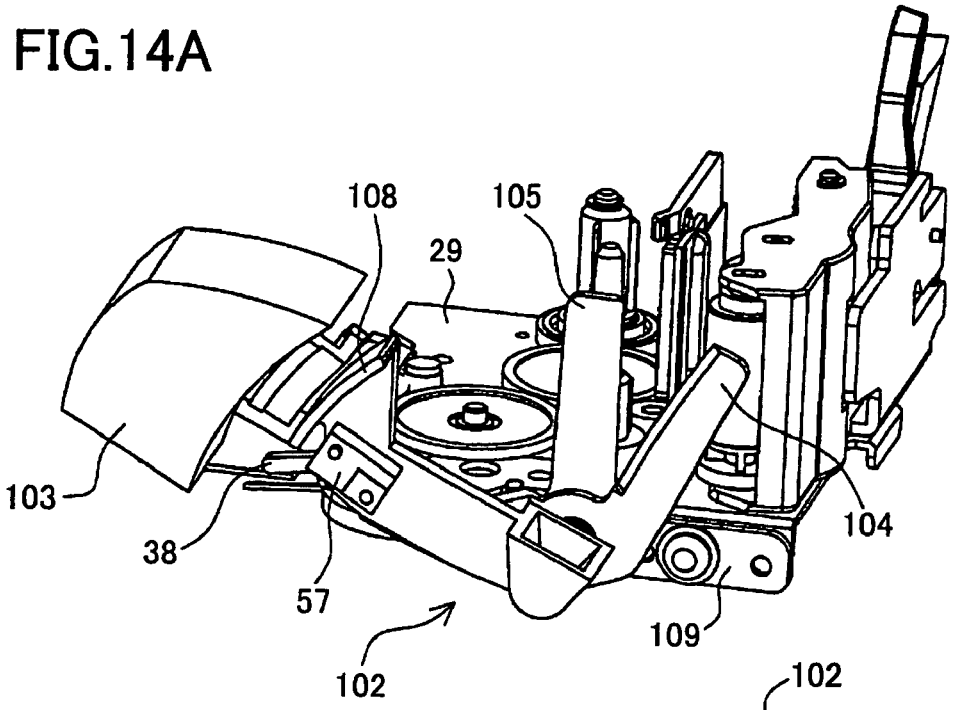
FIG. 14A is a perspective view showing the tape-cutting mechanism of a scissors-type tape-cutting mechanism of a tape printer according to a second embodiment of the invention.
Figure 14B:
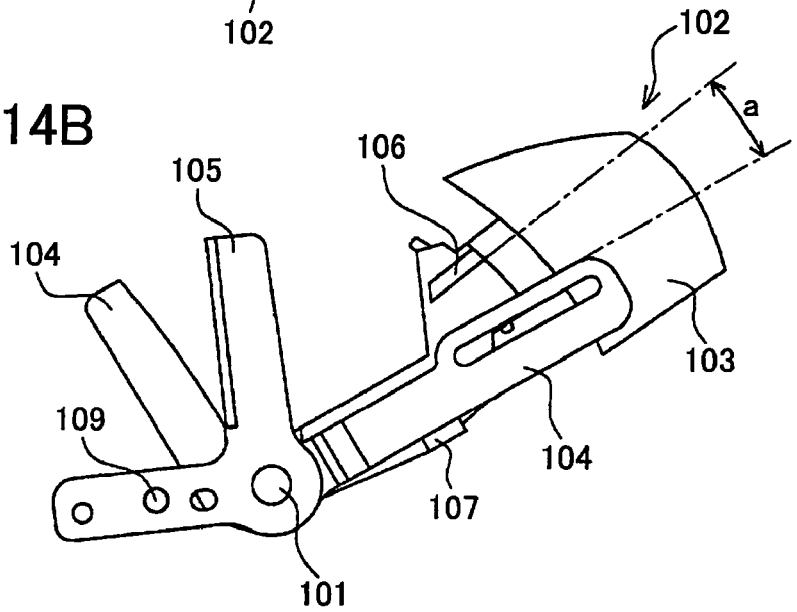
FIG. 14B is an explanatory diagram showing the tape-cutting mechanism in a standby state according to the second embodiment of the invention.
Figure 14C:
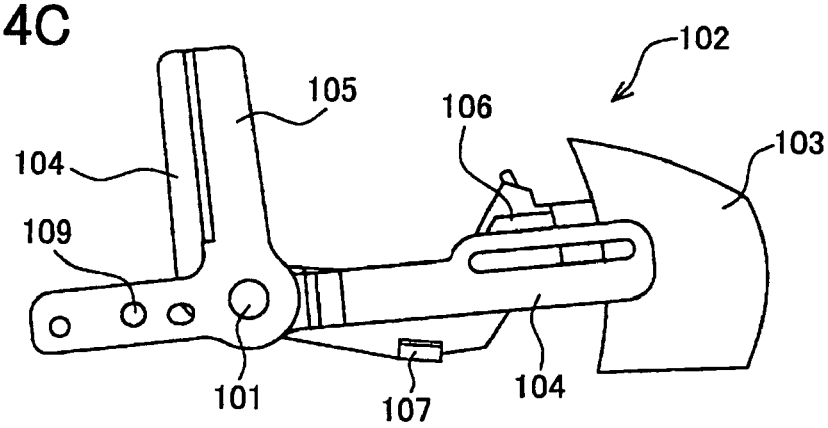
FIG. 14C is an explanatory diagram showing the tape-cutting mechanism after cutting the printing tape according to the second embodiment of the invention.

Next, a tape printer according to a second embodiment of the invention will be described with reference to FIGS. 14A through 14C. FIGS. 14A through 14C illustrate the structure and operations of a scissors-type tape-cutting mechanism of a tape printer according to a second embodiment of the invention. FIG. 14A is a perspective view showing the tape-cutting mechanism mounted on a frame. FIG. 14B shows the tape-cutting mechanism in a standby state. FIG. 14C shows the tape-cutting mechanism after cutting the printing tape.

First, the overall structure of a scissors-shaped tape-cutting mechanism 102 of the tape printer 1 according to the second embodiment will be described with reference to FIG. 14A, wherein like parts and components are designated with the same reference numerals to avoid duplicating description. The tape-cutting mechanism 102 rotates about a rotational shaft 101. The tape-cutting mechanism 102 includes primarily a fixed blade 105, a movable blade 104, and a cutter lever 103. The cutter lever sensor 57 having the sensor lever 38 is mounted on the casing 2. The tape-cutting mechanism 102 also includes a movable blade pushing/cutting rib 106 for operating the movable blade 104, and a movable blade returning rib 107 for returning the movable blade 104 to its original position. An elastic member (not shown) constantly urges the cutter lever 103 in a direction that keeps the scissors shape of the tape-cutting mechanism 102 open. A sensor lever pressing part 108 is disposed on the movable blade 104 for pressing the sensor lever 38 of the cutter lever sensor 57. The tape-cutting mechanism 102 having this construction is mounted on the frame 29 by a mounting part 109 of the fixed blade 105.

Next, the operations of the scissors-shaped tape-cutting mechanism 102 will be described with reference to FIGS. 14B and 14C. In FIG. 14B, the tape-cutting mechanism 102 is in a standby state, with the movable blade returning rib 107 pushing up the cutter lever 103 to form a gap a between the movable blade pushing/cutting rib 106 and the movable blade 104. While the tape-cutting mechanism 102 is in this state, the printing mechanism 28 can perform a tape-feeding operation and printing operation on the printing tape 6.

Next, the cutter lever 103 is pushed a distance of about a/2 so that the sensor lever pressing part 108 pushes the sensor lever 38 until the cutter lever sensor 57 is turned on. At this time, the controller 50 immediately halts the tape-feeding operation and printing operation on the printing tape 6 performed by the printing mechanism 28. As the user presses the cutter lever 103 farther, the movable blade pushing/cutting rib 106 contacts the movable blade 104, and the movable blade 104 and fixed blade 105 begin cutting the printing tape 6. The a/2 rotation of the cutter lever 103 provides a margin when the user accidentally touches the cutter lever 103.

FIG. 14C shows the tape-cutting mechanism 102 when the cutter lever 103 has been pushed farther until the printing tape 6 has been completely cut. When the user subsequently releases the cutter lever 103, the elastic member (not shown) causes the movable blade returning rib 107 to contact the bottom edge of the movable blade 104 and return the movable blade 104 to the original position shown in FIG. 14B.

As described in detail above, the tape printer 1 according to the second embodiment includes the cutter lever 103 that is capable of moving within a prescribed operating range, the tape-cutting mechanism 102 for cutting the printing tape 6 after the printing tape 6 has been printed by the thermal head 13 when the cutter lever 103 moves past a prescribed range, the cutter lever sensor 57 for detecting movement of the cutter lever 103 within the prescribed operating range, and the drive circuits 60 and 62 for halting the tape-feeding operation and printing operation controlled by the controller 50 when the cutter lever sensor 57 detects an operation by the cutter lever 103. With this construction, the printing mechanism 28, which includes a tape-feeding mechanism, is completely halted when the tape-cutting mechanism 102 is operated, thereby eliminating all tape jams.

Further, in the tape printer 1 according to the second embodiment, the cutter lever sensor 57 determines that the operation of the cutter lever 103 is an operation for contacting the movable blade 104 when the cutter lever 103 is approximately in the middle of the operating range, thereby preventing the movable blade 104 from being operated when the user mistakenly touches the cutter lever 103.

While the invention has been described in detail with reference to specific embodiments thereof, it would be apparent to those skilled in the art that many modifications and variations may be made therein without departing from the spirit of the invention, the scope of which is defined by the attached claims.

What is claimed is:

1. A tape printer comprising:

a printing unit having a tape-feeding mechanism that performs a feeding operation of a tape accommodated in a tape cassette, and a print head that performs a printing operation on the tape to provide a printed tape;

a cutting operation member that moves within a prescribed range of motion;

a cutter unit that cuts the printed tape when the cutting operation member is moved more than a distance corresponding to a gap formed between the cutting operation member and the cutter unit from a condition in which the cutting operation member is in a standby position within the prescribed range of motion;

an operating member detecting unit that detects an operation of the cutting operation member moving within the gap; and a controller that controls the tape-feeding mechanism and the print head to halt the tape feeding operation and the printing operation when the operating member detecting unit detects an operation of the cutting operation member.

2. The tape printer according to claim 1, wherein the operating member detecting unit detects that the cutting operation member is moved to a position approximately in a center of the gap and outputs a detection signal to the controller.

3. The tape printer according to claim 2, wherein the controller halts the tape feeding operation and printing operation in response to the detection signal.

4. The tape printer according to claim 1, wherein the tape comprises a transparent film having a printing surface on which an image is formed by the printing operation, and a double-sided tape bonded to the printing surface of the transparent film.

5. The tape printer according to claim 4, wherein the tape cassette comprises a first supply spool around which the transparent tape is wound in a roll shape; a second supply spool around which the double-sided tape is wound in a roll shape; a third supply spool around which an ink ribbon for printing the image on the printing surface of the transparent tape is wound in a roll shape; and a take-up spool that takes up a portion of the ink ribbon that has been used for printing.

6. The tape printer according to claim 5, wherein the tape feeding mechanism discharges the printed tape out of the tape cassette and fixes the double-sided tape to the printing surface of the transparent film.

7. The tape printer according to claim 6, wherein a user manipulates the cutting operation member to move more than the distance corresponding to the gap formed between the cutting operation member and the cutter unit from the condition in which the cutting operation member is in the standby position within the prescribed range of motion.

8. The tape printer according to claim 7, further comprising a cutter receiving member disposed to confront the cutter unit, wherein when the cutting operation member is not manipulated by the user, the cutter unit is disposed in a position to preserve a space for allowing the printed tape to pass between the cutter unit and the cutter receiving member.

9. The tape printer according to claim 8, wherein the operating member detecting unit comprises a detection lever, and the cutting operation member comprises an engagement portion, wherein when the cutting operation member is manipulated by the user, the detection lever is in a position separated from the engagement portion whereas when the cutting operation member is not manipulated by the user, the detection lever is held in contact with the engagement portion.

10. The tape printer according to claim 9, wherein the operating member detecting unit detects that the cutting operation member is moved to a position approximately in a center of the gap and outputs a detection signal to the controller.

11. The tape printer according to claim 10, wherein the detection signal is produced from the operating member detecting unit when the detection lever is changed from a contact state in which the detection lever is in contact with the engagement portion to a separated state in which the detection lever is separated from the engagement portion.

12. The tape printer according to claim 1, wherein the cutting unit is disposed downstream of the print head with respect to a direction in which the printed tape is discharged out to the tape cassette.

* * * * *